United States Patent [19]

Fokos et al.

[11] Patent Number: 5,001,950

[45] Date of Patent: Mar. 26, 1991

[54] ROTARY DIE CUTTER

[75] Inventors: Robert Fokos, Wayland; Robert M. Williams, Norton; Orfeo J. Salvucci, Holbrook; Albert L. H. Wright, Sherborn, all of Mass.

[73] Assignee: Sequa Corporation, New York, N.Y.

[21] Appl. No.: 470,425

[22] Filed: Jan. 25, 1990

Related U.S. Application Data

[63] Continuation of Ser. No. 257,629, Oct. 14, 1988, abandoned.

[51] Int. Cl.[5] ..... B26D 1/62

[52] U.S. Cl. ..... 83/37; 83/344; 83/346; 83/499; 83/700

[58] Field of Search ..... 83/346, 344, 347, 498, 83/499, 501, 502, 504, 508.3, 530, 663, 699, 700, 628, 37

[56] References Cited

U.S. PATENT DOCUMENTS

| | | | |
|---|---|---|---|
| 393,535 | 11/1888 | Browne | 83/499 |
| 1,122,268 | 12/1914 | Feeley | 83/504 X |
| 3,448,684 | 6/1969 | Cardinet et al. | 83/344 X |
| 3,570,348 | 3/1971 | Hallden | 83/344 X |
| 4,095,498 | 6/1978 | Biggar, III | 83/347 X |
| 4,359,919 | 11/1982 | Fuchs et al. | 83/344 X |
| 4,438,673 | 3/1984 | Noffke et al. | 83/502 |
| 4,463,640 | 8/1984 | Cogswell et al. | 83/116 |
| 4,466,319 | 8/1984 | Cogswell et al. | 83/116 |
| 4,467,687 | 8/1984 | Fokos et al. | 83/674 |
| 4,537,104 | 8/1985 | Dealto et al. | 83/700 X |
| 4,553,461 | 11/1985 | Belongia | 83/346 X |

*Primary Examiner*—Douglas D. Watts
*Assistant Examiner*—Rinaldi Rada
*Attorney, Agent, or Firm*—Mitchell D. Bittman

[57] ABSTRACT

A rotary die cutter includes an anvil roll and at least one die roll. One or more sheet metal dies with raised cutting edges are carried on the die roll to cut patterns in a web of material passing between the die and the anvil roll. The die cutter has a pair of rigid side frames spanned by a very rigid spreader. While the anvil roll is end-mounted between the side frames, the die roll is mounted from the spreader. A drive shaft rotatable in the side frames and driven from a lineshaft by a gear system transits rotation to the die roll, while allowing the die roll freedom of movement for independent vertical, axial and circumferential adjustments. This mounting and drive of the die roll can accommodate a full width press web using die rolls having a small diameter, typically a single repeat roll, and one whose length is comparable to its circumference. A pair of mutually slidable wedges acting against a spring clamping force adjusts the vertical position of bearing blocks that rotatably mount the die roll. The mounting structure also preferably includes slide rails that extend parallel to the die roll and a threaded shaft to adjust the axial position of the die roll. Adjustably rotating only the gear system, or a portion of the gear system directly associated with the die roll, adjusts the circumferential position of the die roll.

27 Claims, 4 Drawing Sheets

ROTARY DIE CUTTER

This application is a continuation of application Ser. No. 07/257,629, filed Oct. 14, 1988, now abandoned.

BACKGROUND OF THE INVENTION

This invention relates generally to systems and processes for mounting and very accurately positioning rotating rolls acting in cooperation with an opposed anvil roll on a material or web passing through the roll nip. More specifically, it relates to a roll mounting and positioning system for inline web finishing equipment for use in conjunction with a web printing press.

Rotary die cutters are well known for cutting apertures of various sizes and shapes in a running web, particularly a web operating in conjunction with a printing press. A classic application of such die cutters is to cut out a set of peel-off labels carried on a backing sheet. Reduced to its essentials, known rotary die cutters utilize a pair of rolls rotating about two parallel axes that are rotatably mounted between a pair of side frames and driven by a line shaft which also powers the printing press. One roll, designated as the die roll, or cylinder, carries flexible sheet metal dies on its outer surface which are the cutting members. Each die is formed from a thin metal sheet and has raised cutting edges formed in the shape of an aperture to be cut. The die is wrapped around the die cylinder and replaceably secured to it, usually utilizing magnetic attraction produced by embedded permanent magnets in the die cylinder. Dies can also be secured by tapes, mechanical clamps, or other types of fasteners. The anvil cylinder is formed of a hardened material and is of such diameter that its surface speed is substantially equal to web speed.

As the web passes between the rotating cylinders, the cutting edges of the die are pressed into the web backed up by the anvil cylinder to produce the desired aperture in the web. To the best of applicant's knowledge, heretofore such rotary die cutters, at least when used in printing press applications, have always end-mounted both the die roll and the anvil roll and side frames. Because the web leaving the printing press has a substantial width, a significant problem has been the deflection of the die roll caused by operating forces, machine distortions, vibrations, and thermal expansions. The traditional solution has been to utilize a roll having a sufficiently large diameter that it is able to resist any significant deflection. This works, but the necessary roll diameter has been such that for most product lengths (cut offs) there is a "double repeat", that is, the image or pattern being printed is repeated during one revolution of the die cylinder.

The disadvantage of this solution is that a die cylinder with a double repeat diameter is massive and costly to manufacture, particularly where the outer surface of the die cylinder must be machined to extremely tight tolerances. In addition, the substantial rotational inertia of such a large diameter die roll is an impediment to achieving a fast stop of the printing line during an emergency stop.

Other disadvantages relate to the need to have the apertures extremely accurately located so that they are in registration with the pattern printed on the web. A "vertical" adjustment of the die, one affecting the spacing between the die and anvil rolls, is also important to adjust the spacing between the cutting edges of the die and the anvil cylinder. This is important, for example, so that the die achieves a reliable cut in the web, the cutting edge does not strike the anvil cylinder and become dulled or damaged, and so that the correct spacing occurs across the full length of the die roll. In addition, as is well known to those skilled in the art, even when proper adjustments in the position of the dies are made, changes in factors such as the web material, wear of the die, and shifts in the relative position of components due to thermal expansion can require periodic readjustments of the die positions in order to have reliable apertures continue to be cut in the web.

In the prior art systems, the principal technique currently used to adjust the vertical position of a die with respect to a die roll is to place a shim between the die and the roll manually. This is a tedious and time-consuming procedure since the shims must be positioned with the die cutter stopped, the selection and placement of the shim is to some extent guesswork, and then the adjustment must be measured or tested by operating the die cutter to observe the effect of the adjustment. Not only does this procedure suffer from the fact that it is manual and requires at least a modest degree of skill, but also it requires that the printing press be stopped while the adjustments are made and checked. As is well known, any stoppage of the press is costly in terms of lost productivity. In addition, in placing the shim there is always a risk that the correct axial or circumferential positioning of the die in the roll may be lost requiring still further adjustments. It is also very important to note that the positioning must be controlled to extremely tight tolerances. Typically, control to one-tenth of a mil (0.0001 inch) is required.

Another known technique for changing the axis to axis (vertical) spacing of the rolls is to mount at least one of the rolls on an eccentric so that its center line location can be varied between two extreme positions. Such adjustments cannot be made on the run, that is, while the press is running and the web is passing through the rotating die cutter cylinders. Axial and circumferential adjustments of the die also require that the press be stopped while the die position is manually shifted on the die cylinder and reset. The adjustment process is manual, time-consuming, and cannot be made on the run. Also, eccentric adjustments do not provide the fine degree of adjustment often required to compensate for wear or the other factors listed above. When eccentrics have been used while the rotary die cutter is operating, they have been used most often to move the die roll a substantial distance to go "off impression", that is, moving the die cylinder away from the web to allow operation of the press line without operation of the die cutter.

It is also significant to note that conventional rotary die cutters utilize only one die cylinder and that the only practical way to adjust the axial or side to side position of the web is to shift the lateral position of the web as it passes through the cutter. This web shift works, but it has a significant disadvantage in that it requires that all of the other pieces of equipment in the line, such as gluers, perforators, numbering machines or plow stations, also be adjusted with respect to the web to maintain registration. This multiple adjustment of a series of machines to the web shift is time-consuming and tedious. However, no rotary die cutters presently known to applicants are capable of an axial or "sidelay" adjustment of the cutter.

It is therefore a principal object of this invention to provide a mounting and positioning system for a rotary die cutter which utilizes a small diameter, single repeat roll and yet which exhibits extreme rigidity.

Another principal object of the invention is to provide a mounting and positioning system with the foregoing advantages which provides extremely accurate positioning of the die with respect to the web and its anvil roll, vertically, axially, and circumferentially.

Yet another principal object of the invention is to provide a rotary die cutter positioning and mounting system with the foregoing advantages where the foregoing adjustments can be made with extreme accuracy, independently of one another, and while the die cutter is operating.

A further object of the invention is to provide a rotary die cutter mounting and positioning system which can be set up or adjusted within extremely short make ready time as compared to conventional systems currently in use.

Still another object of the invention is to provide a mounting and positioning system for a rotary die cutter which can mount two or more die rolls in an axially spaced relationship operating in cooperation with the same anvil where each die roll can be adjusted vertically and axially independently of the other with all of the foregoing advantages.

Another object of the invention is to provide a roll positioning and mounting system for a rotary die cutter for use in connection with a printing press which can handle a full width web offset, or can simultaneously run jobs having different dies or die patterns side-by-side.

A further object of the invention is to provide a mounting and positioning system for a rotary die cutter which has a reduced rotational inertia as compared to prior art devices and therefore can be brought to an emergency stop more quickly.

Still another object is to provide a mounting and positioning system for a rotary die cutter which has a favorable cost of manufacture and which requires fewer dies for operation since the pattern can be completed once every revolution rather than twice as was the case with prior art devices.

Yet another advantage is to provide a mounting and positioning system with the foregoing advantages which also provides a rapid off-impression capability.

SUMMARY OF THE INVENTION

The present invention involves a mounting and positioning system for a roll, particularly a die roll of a rotary die cutter used for inline web finishing in conjunction with a web printing press. The die roll is operated in conjunction with an opposed anvil roll. The axes of rotation of the die and anvil rolls are parallel. The die cutter of the present invention utilizes a pair of extremely rigid side frames, typically frames formed of 2 ½ inch thick steel, and an extremely rigid spreader. Preferably a hollow steel beam with a generally square cross section, which extends between and is secured to the side frames. The anvil roll is rotatably mounted directly in the side frames.

At least one, preferably two, axially spaced and coaxial die rolls are rotatably mounted in bearing blocks supported from the spreader, not end mounted in the side frames, to separate the drive for the rolls from the positioning of the rolls. The die rolls have a comparatively small diameter, typically a single repeat roll when used with a web printing press, and preferably are comparatively short, with the length being comparable to the die circumference. In the preferred form, the bearing blocks, and the die rolls mounted in the bearing blocks, are adjustably mounted with a compliant clamping to provide a well controlled and precise adjustment of the vertical position of the die roll. The bearing blocks are preferably secured to a bed plate having side rails which receive a set of clamping bolts. A stack of Belleville springs is captured under the head of each bolt to produce a compliant, vertically-directed clamping that maintains a solid, metal-to-metal contact between the spreader and the die roll through the parts interposed between them. This solid clamping faithfully transmits the rigidity of the spreader to the die roll. A horizontal movement of an opposed pair of wedges with mating inclined faces, acting on the bed plate, produces a uniform vertical adjustment in the position of the die roll acting against the compliant clamping. A pneumatic actuator acting on the wedges provides an off-impression capability which does not lose the original precise positioning of the die roll after it returns to its on-impression position.

A horizontally oriented screw translates a follower block to adjust the axial position of the die roll. In the preferred form, the axial adjustment mechanism includes an axially extending slideway having downwardly sloped outer side surfaces which mate with and capture a pair of dovetail guide rails secured to a fixed one of the wedges. In this preferred form, an outwardly extending flanged portion of each dovetail rail receives the vertical clamping bolt and the Belleville spring stack.

Rotary drive power is transmitted from a printing press lineshaft to the die cylinders and the anvil roll through a gear train. The transmission includes a planetary gear box which is coupled between the lineshaft and a drive shaft for the die roll, or rolls. A motorized drive adjusts the angular position of the planet gears with respect to the lineshaft to produce a corresponding adjustment in the circumferential position of the die roll with respect to the web.

The drive shaft is generally co linear with the axis of rotation of the die rolls. However, it and the die rolls are structured so that it transmits a driving or positioning adjusting rotation. In particular, the die rolls are not fixed on, or integral with, the drive shaft, as is the case with commercial prior art arrangements. The die rolls are free to slide axially along the drive shaft to the control of the adjusting lead screw and to move vertically, within predetermined maximum limits, under control of the aforementioned vertical adJustment system, including a pair of opposed wedges. A preferred arrangement for achieving these operational characteristics includes a plurality of splines which extend axially along the outer surface of the drive shaft and are received in mating, oversized recesses formed in the body of the die roll that couple the die roll to the drive shaft.

Stated as a process for mounting and positioning a single roll with respect to a fixed anvil roll, the process involves steps of providing a pair of rigid side frames, providing an extremely rigid spreader extending between the side frames, providing a small diameter, single repeat roll whose width is less than a spacing between the side frames, driving the die roll in a rotating motion where the drive only transmits a positive rotation to the die roll, but otherwise leaves it uncoupled for adjusting movements with two degrees of freedom, and independently adjusting the position of the die roll axially, vertically, and circumferentially.

These and other features and objects of the foregoing invention will be more readily understood with reference to the following detailed description of the preferred embodiments which should be read in light of the accompanying drawings.

DETAILED DESCRIPTION OF THE PREFERRED EMBODIMENTS

Figure 1:
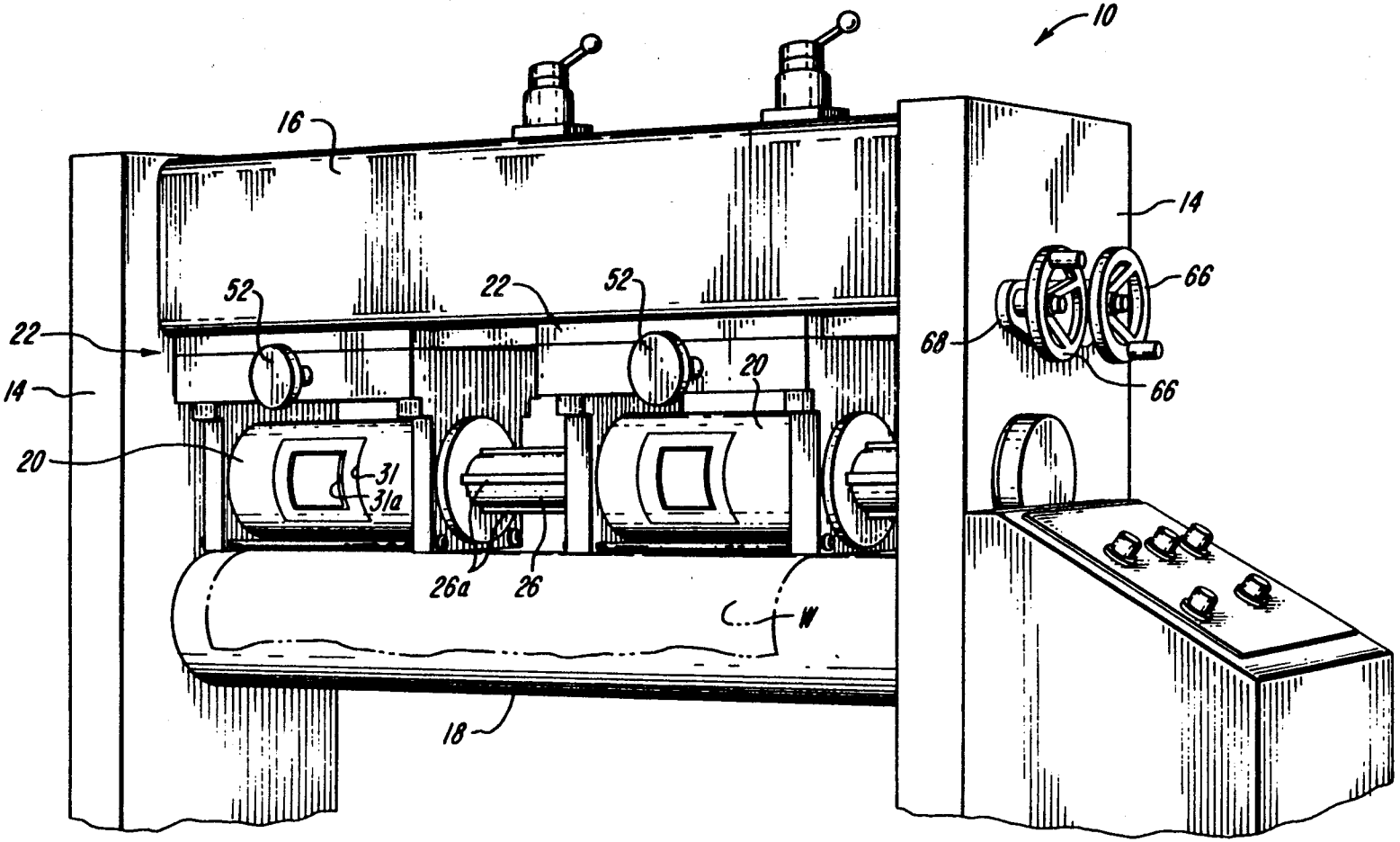
FIG. 1 is a simplified perspective of a rotary die cutter according to the present invention having two coaxial die rolls driven by a common drive shaft and coacting with a common anvil cylinder.
Figure 2:
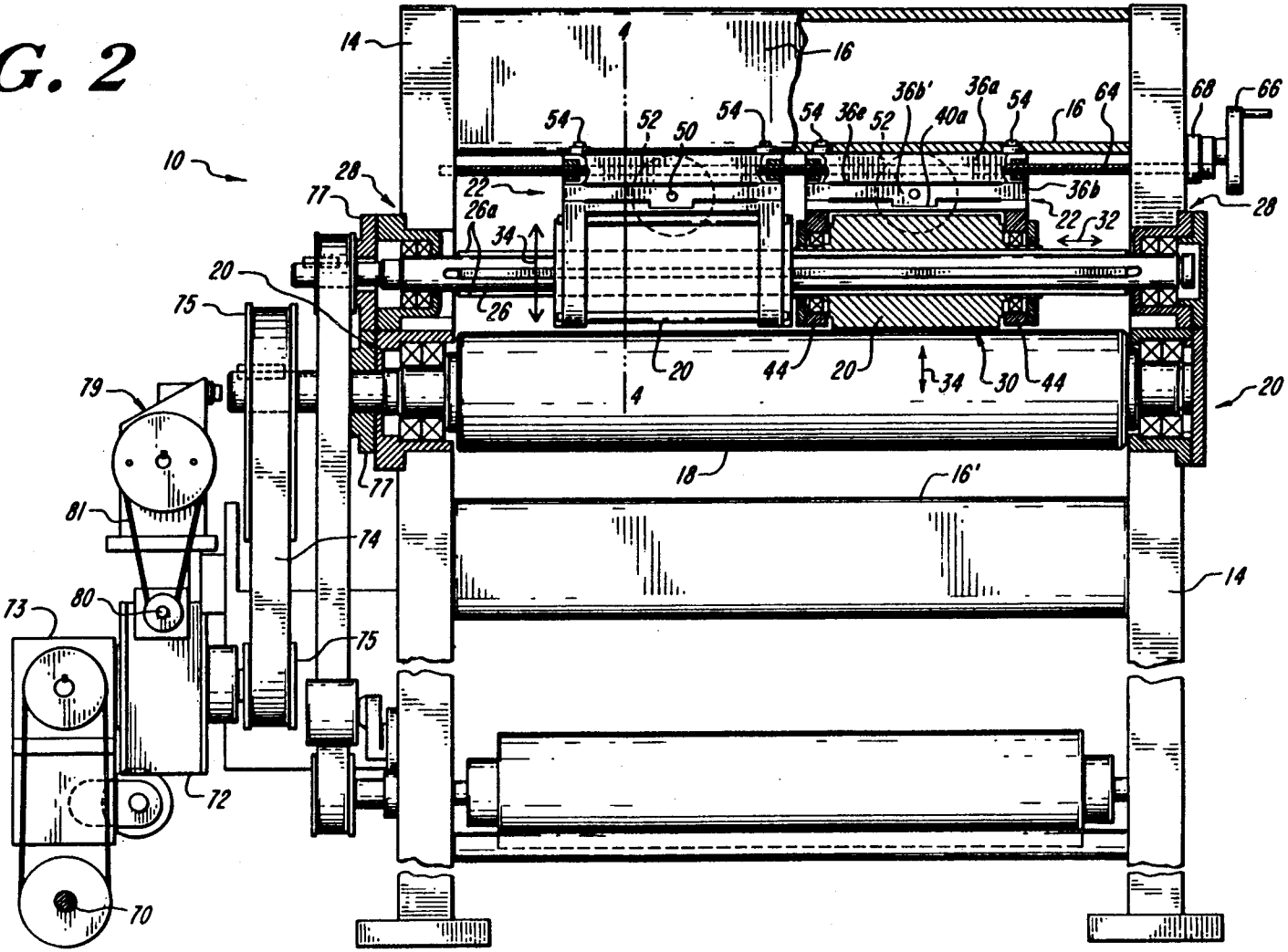
FIG. 2 is a view in front elevation, and partially in vertical section, of the rotary die cutter shown in FIG. 1 with a control panel removed and showing associated additional rolls and the drive system for rotating all of the rolls illustrated.
Figure 3:
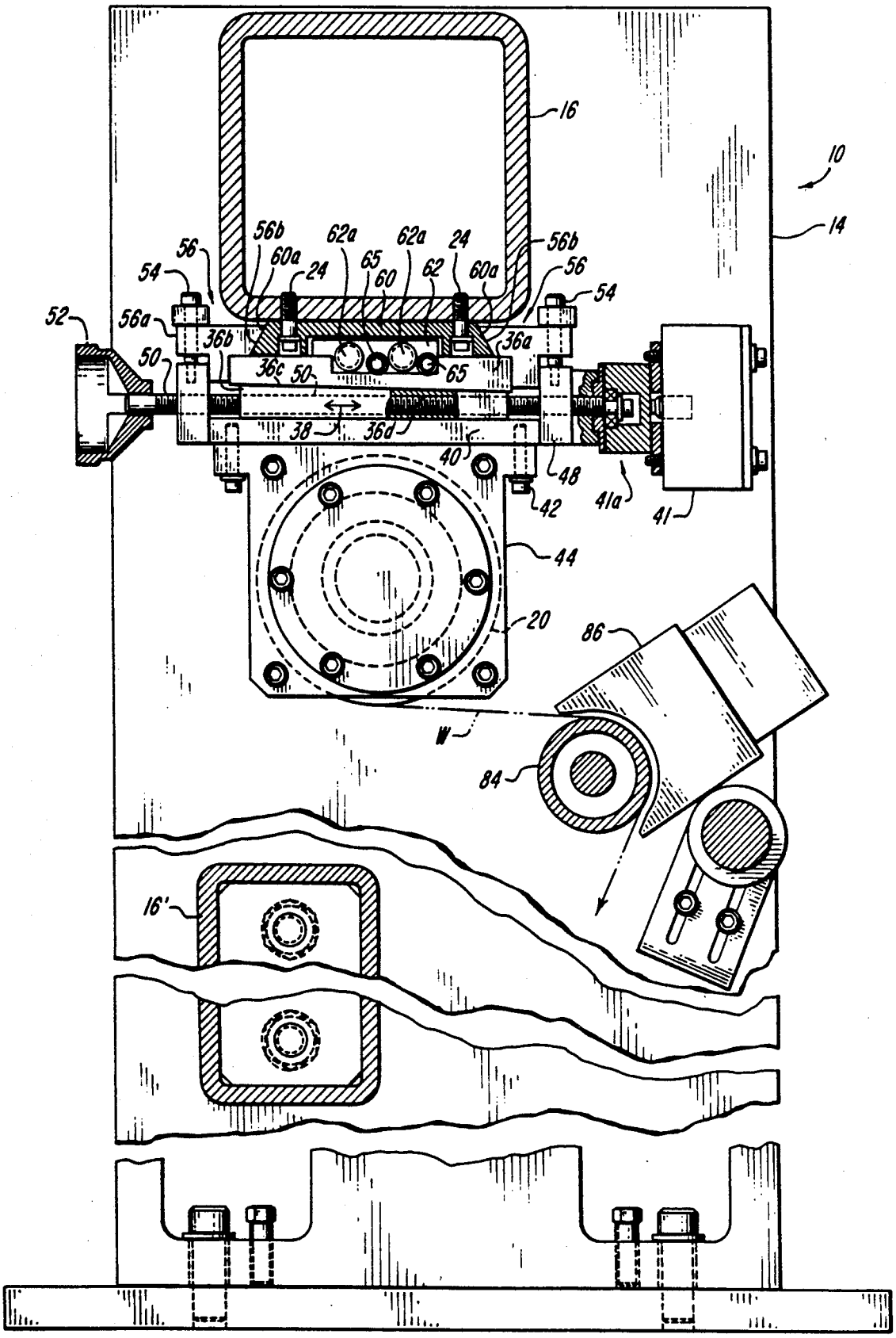
FIG. 3 is a view in side elevation and partially in vertical section, with portions broken away, of the rotary die cutter shown in FIGS. 1 and 2.

FIGS. 1-3 show a rotary die cutter assembly according to the present invention which is adapted particularly for use on line in conjunction with a web printing press to produce a pattern of apertures in a web W being printed. The die cutter assembly 10 includes a pair of generally upriqht and extremely rigid side frames 14, preferably formed of steel having a thickness of approximately 2 ½ inches that are bolted or otherwise secured to the ground or floor. A massive and extremely rigid spreader 16 extends between and is secured to the frames 14,14 at their upper end to produce an extremely rigid parallelogram frame assembly. The spreader 16 is preferably formed of a hollow steel member having generally rectilinear cross section, as best seen in FIG. 3. The walls of the spreader 16 preferably have a thickness of at least ½ inch formed of steel. The side frames 14,14 and the spreader 16 are sufficiently rigid that they exhibit negligible deflection in response to operating forces, machine distortions, and machine vibrations. In the preferred form shown, the frame also includes a second spreader 16', similar in construction to the spreader 16, and also secured between the side frames 14,14, but located below the anvil roll 18.

An anvil roll 18 is end mounted directly in bearing assemblies 21,21 which are in turn mounted in the side frames 14,14. The anvil roll of a type conventional in the industry is formed of hardened steel of a sufficient diameter to resist deflection.

Principal features of the present invention are a pair of die rolls 20,20 supported and positioned by mounting assemblies 22,22 all of which are bolted to the bottom of the spreader by bolts 24 (FIG. 3). A drive shaft 26 journaled in bearing assemblies 28,28 end-mounted in the side frames 14,14 transmits a torque to rotate the die rolls 20,20 in coordination with the movement of the web through a nip 30 between the die rolls and the anvil cylinder 18. The die rolls each carry at least one die 31 having at least one raised cutting edge **31*a*** that cuts the desired aperture in the web. As shown, the dies are thin metallic sheets of conventional design and are secured to the die roll magnetically using well known techniques.

It is a significant aspect of the present invention that while the spreader and drive shaft are end supported in the side frames, the die rolls are not rigidly secured to the drive shaft 26 and can be moved axially with respect to the drive shaft independently of one another, as well as adjusted vertically, where "vertical" means the plane defined by the axes of rotation of the die rolls and the anvil roll as indicated by the arrow 34. It is also significant that the die rolls 20,20 can exhibit extreme rigidity when subjected to web cutting forces (usually in excess of 200 pounds/inch for a line cut), while having a comparatively small diameter, typically one yielding a circumference that is equal to only a single repeat of the pattern being printed on the web. Preferably the die rolls are also comparatively short, with a length of approximately the same as the circumference.

The mounting assembly 22 is clamped and vertically adjustable utilizing a pair of wedges **36*a* and 36*b* each having an inclined, mating cam surface 36*c*. As shown, the wedge 36*a* is fixed with respect to the spreader. The wedge 36*b*, however, is movable laterally in the direction of arrow 38, which produces a uniform change in the vertical position of a bed plate 40 with respect to the spreader 16. As is best seen in FIGS. 2 and 3, the bed plate 40 has a groove 40*a* which receives a mating tongue 36*b'* of the movable wedge 36*b* to guide the translation along the direction 38. This direction is perpendicular to the axis of rotation of the die rolls 20 and oriented with respect to the inclination of the wedge surfaces 36*c* to maximize the vertical camming motion of the wedges in response to a given horizontal relative motion between the wedges 36*a*, 36*b*. The change in the vertical displacement of the wedges is, of course, reflected in corresponding vertical movement of components such as the bed plate 40 secured to or otherwise movable vertically in unison with the wedge 36*b*. A pneumatic actuator 41 acting through a bearing assembly 41*a* rapidly drives the movable wedge 36*b* between two limit positions. In one limit position, as shown, the die roll is positioned and adjusted so that the dies 31** are in a cutting relationship with respect to the anvil roll ("on impression"). In another limit position, corresponding to a horizontal travel of about ½ inch, the die roll is sufficiently spaced from the anvil roll that no cutting occurs ("off impression"). The limit positions are precisely defined by stops so that upon returning to "on imptession" operation, the original position of the die roll, axially, vertically and circumferentially, is established with reliability and precision.

Bolts 42 mount bearing blocks 44 which in turn mount and guide the die rolls 20,20. The bed plate 40 has a pair of axially extending side rails 48,48 which may be formed integrally with the bed plate, or secured to the bed plate as by welding or with bolts. Each side rail 48 extends vertically a sufficient distance to provide a clearance for the wedges **36*a*,36*b*, and rotatably supports a lead screw 50 which is engaged in a threaded hole 36*d* formed in the movable wedge 36*b*. Rotation of a hand wheel 52 on one end of the lead screw 50 produces a horizontal translation of the wedge 36*b* along the direction 38, and thereby an adjustment in the vertical position of the bed plate 40 and the die roll 20 with respect to both the spreaded 16 and the anvil roll 18, which are fixed in position with respect to the side frames 14,14**.

Figure 5:
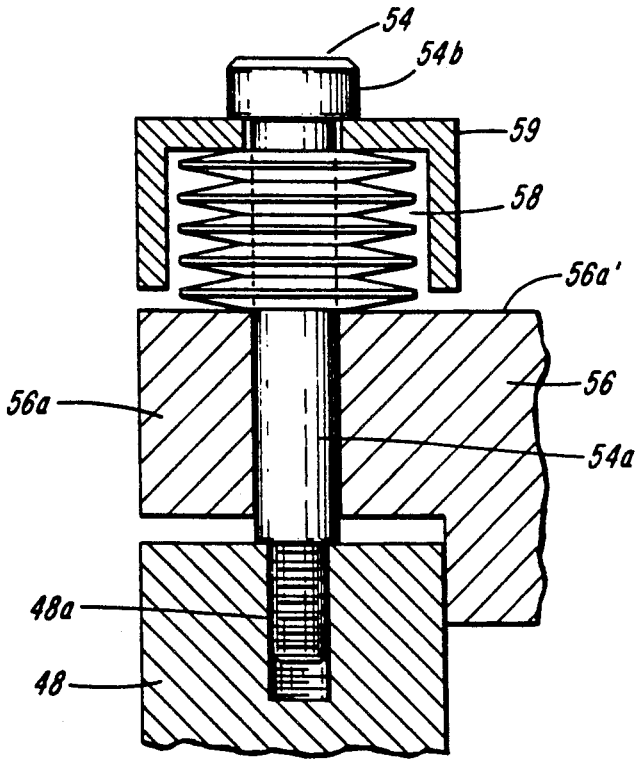
FIG. 5 is a detailed view in vertical section of the compliant clamping arrangement for the die rolls to transmit the rigidity of the spreader to the die roll or rolls despite the vertical adjustability of the mount for each die roll.

The side rails also have threaded holes 48*a* in their upper surface which receive bolts 54, as shown in detail in FIG. 5. The end of each bolt threads into the hole 48*a*, but the bolt has a smooth shoulder portion 54*a* that passes freely through (1) an outwardly projecting flange portion 56*a* of a dovetail rail 56 and (2) a stack 58 of Belleville springs captured between a head 54*b* of the bolt 54 (acting through an intermediate cap 59 located over the Belleville stack 58) and the upper surface 56*a'* of the flange portion 56*a*. When the bolt 54 is sufficiently threaded into the hole 48*a*, the Belleville washers 58 compress and generate a clamping force that urges the bed plate toward the spreader and clamps these members and the wedges 36*a*, 36*b* caught between them into a firm, metal to metal contact. This clamping avoids any resiliency or "play" in the support structures 22,22 so that the rigidity provided by the spreader is transmitted to the die rolls 20,20 by the mounts 22,22. The cam action of the wedges 36*a*,36*b* acts in cooperation with this spring clamping to provide a precisely controlled and highly accurate adjustment in the vertical position of the die rolls 20,20 through a rotation of the handwheel 52 and a corresponding rotation of the lead screw 50. In a preferred form, the pitch of the inclined surfaces 36*c* and the pitch of the threads and the lead screw 50 are such that one complete rotation of the handwheel 52 produces a uniform change in the vertical position of the die roll 20 with respect to the anvil roll 18 of one mil. The handwheel 52 is preferably calibrated so that rotation through 36° produces a well-controlled, reliable vertical adjustment in the position of the die rolls in the order of at least one tenth of one mil (0.0001 inch).

Axial adjustment of each of the die rolls 20 is provided by an axially extending slideway 60 secured by the bolts 24 to the spreader 16 and having a pair of outwardly sloped side surfaces 60*a*,60*a* which mate with correspondingly sloped surfaces 56*b* of the dovetail rails 56. This dovetailing captures each entire mounting assembly 22, and therefore the associated die rolls 20, on the slideway 60. A follower block 62 is secured by bolts 65 to the fixed slide 36*a*. The follower block has at least one threaded hole 62*a* which receives a lead screw 64 rotated by handwheel 66 through a belt or chain 68. Each screw is journaled in bearings mounted in the side frames 14,14. Rotation of the handwheels 66,66 rotates an associated lead screw 64,64 causing an axial movement of the mounting assemblies 22 and a corresponding axial movement or "sidelay" of the die rolls 20,20 as the follower block 62,62 thread along the lead screws 64,64. Each lead screw and follower block 62,62 operates independently on an associated one of the mounting assembly 22 and its associated die roll 20 so that there is an independent axial adjustment of each die roll. This sidelay adjustment can be made while the press and the rotary die cutter 10 are operating. To the best of applicants' knowledge, no prior art rotary cutter is capable of a comparable sidelay adjustment, let alone a lateral or axial adjustment of two rotary dies independently of one another.

Power for the rotary cutter originates with a rotating line shaft drive 70. A miter gear box 73 transmits rotary power to a planetary gear train 72 which is coupled through a conventional belt 74 and pulleys 75,75 to rotate the anvil cylinder 18. Gears 77,77 secured on the anvil roll and the drive shaft 26 mesh so that this drive also rotates the drive shaft 26, but in a direction opposite to that of the anvil roll. Because the output of the planetary gear box is coupled to the drive shaft, an angular rotation of the planet gear carrier results in a corresponding angular shift in the position of the drive shaft 26 with respect to the angular position of the line shaft. This angular phase shift provides an adjustment in the circumferential position of a die 31 mounted on the outer surface of the die rolls 20,20, thereby providing adjustment in the position of the aperture cut by the die in the web W in its running direction. A motor 79 acting through belt 81 drives a worm gear shaft 80 in the planetary gear box to produce the desired circumferential adjustment. Again, it is significant to note that this circumferential adjustment is independent of the vertical adjustment provided by the rotation of the handwheels 52 or the axial or sidelay adjustment provided by the rotation of the handwheel 66,66.

Figure 4:
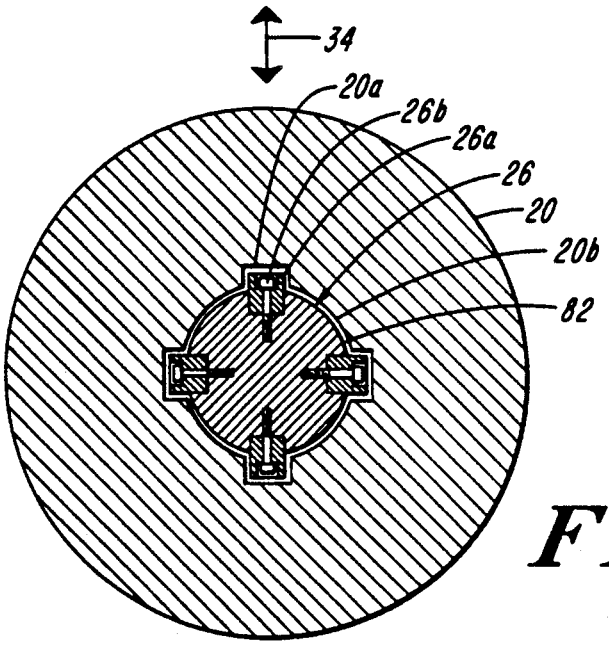
FIG. 4 is a detailed view in vertical section of a die roll and its associated drive shaft taken along line 4—4 in FIG. 2.

With particular reference to FIG. 4, the drive shaft 26 has four equiangularly spaced and axially extending splines 26*a* each secured by a series of screws 26*b*. Each spline is surrounded by an oversized recess 20*a* formed in the body of the die roll 20 and a central cylindrical passage 20*b* also formed in the die roll 20 with a clearance 82 there between. The size of the clearance 82 is sufficient to allow a free vertical movement of the roll 20 in the direction 34 in response to an adJustment in the relative positions of the wedges 36*a* and 36*b*. The clearance 82 also allows an unencumbered sliding movement of the roll 20 along the drive shaft 26 to accommodate an axial sliding movement in the direction 32. However, the splines 26*a* project sufficiently into the associated recesses 20*a* that regardless of the vertical position of the roll 20, rotation of the drive shaft 26 causes a positive mechanical engagement between one edge of the spline 26 with an associated side wall of a recess 20*a* to transmit a rotational torque.

With reference to FIG. 2, the mating faces 36*c* of the wedges contain a central recess 36*e* formed in at least one of the wedges so that the wedges engage one another only at their edges. This avoids the cost associated with machining what would otherwise be two relatively large surfaces to an extremely high degree of flatness. It also promotes lateral stability of the wedges. At least one of the wedges can include passages to direct a flow of lubricant to the interface between the opposed cam surfaces 36*c*,36*c*.

In operation, the web W, which may be a continuous full width web of a conventional width or one or more webs moving in side-by-side relation, travel through the nip 30 of the rotary die cutter where the die or dies 31 carried on the outer surface of the die roll or rolls 20 cuts a pattern of apertures in the web W that is in registration with the pattern being printed on the web by the press. The mounting and drive arrangement of the present invention provides extreme rigidity in the die rolls 20 even though they have a comparatively small, single repeat diameter. The die rolls 20, while preferably being sufficiently short that their length is comparable to their circumference, extend axially to create a pattern of apertures in the web W over its full width at all of the desired locations. Adjustments in the vertical position of each of the die rolls 20,20 can be made conveniently, and independently of one another, by rotating the handwheels 52,52. Similarly, a rotation of the handwheels 66,66 adjusts the axial position of the associated die roll 20,20 on the run. Further, the location of the apertures formed by the dies 31 can be adjusted in the running direction of the web through a rotation of the worm gear shaft 80 causing a corresponding adjustment in the angular position of the drive shaft 26 with respect to the web W. After the cuts have been made by the dies 31, the web W is directed over a very small diameter roll 84 which operates in conjunction with a surrounding suction head 86 to remove from the web the "chips", or trim, cut by the apertures 31*a* of the dies 31.

Stated in terms of a process, the present invention involves mounting, positioning and driving die rolls with respect to an anvil roll for processing a web moving through the nip between the die roll and the anvil roll where the die rolls have a comparatively small diameter and yet are extremely rigid. The process involves the steps of providing rigid side frames and a rigid spreader extending between the side frames, mounting the small diameter die roll or rolls from the spreader, and at the same time driving the die rolls in a manner that transmits only rotation, but does not significantly restrict the vertical or axial position of the die rolls with respect to the anvil roll or the supporting structure. The process of the present invention also includes adjusting the position of the die roll or rolls vertically, axially, and circumferentially where these adjustments are independent of one another.

There has been described a system and process of mounting and positioning a rotary die cutter where a small diameter, single repeat roll provides extreme rigidity and can be positioned with a high degree of precision vertically, axially, and circumferentially with respect to the web and opposed anvil roll. The foregoing mounting and positioning system process provides a substantial reduction in the make-ready time of the rotary cutter as compared to conventional systems, can handle a full width web and can run different jobs on different webs side by side, simultaneously. The present invention also has a favorable cost of manufacture as compared with conventional rotary die cutters, can be brought to an emergency stop quickly, and has an off-impression capability while preserving all of the aforementioned advantages.

While the invention has been described with respect to its preferred embodiments, it will be understood that various modifications and alterations will occur to those skilled in the art from the foregoing details in combination with the accompanying drawings. For example, the invention has been described with respect to a rotary die cutter for use in connection with inline web finishing equipment operating in conjunction with a web printing press. It can also be applied to other roll type apparatus acting on webs such as gluers, pattern perforators, rotary cutters and imprinters such as numbering, bar-coding and embossing apparatus.

Further, while the system has been described with respect to a roll or rolls which are suspended from a spreader, it will be understood that the die roll or rolls could be mounted above a spreader to act on a web or material passing through a nip above the die roll. Also, while the invention has been described with respect to a pair of die rolls acting in cooperation with a fixed anvil roll, die rolls mounted and configured according to the present invention can operate in opposition to one another and the invention includes three or more die rolls mounted and operating in a manner described hereinabove. Further, while various specific mechanical arrangements have been described for producing the adjustment of the vertical, axial and circumferential positions of the die roll or rolls with respect to the web, it will be understood that a wide variety of other equivalent mechanical arrangements will occur to those skilled in the art in view of the detailed description of the present invention. These and other variations and modifications are intended to fall within the scope of the appended claims.

What is claimed is:

1. A process for mounting, positioning and rotating a roll operating on a web passing between it and an anvil roll rotatable about a first axis comprising, providing a pair of rigid side frames, providing a rigid spreader extending between and secured rigidly to said side frames, providing bearing blocks for said roll, mounting said roll in said bearing blocks to rotate about a second axis generally parallel to said first axis, driving said roll to transmit only a rotation without interfering with or controlling the location or adjustment in location of said roll with respect to said side frames or said spreader, said driving including providing a shaft supported at its ends in said side frames and passing freely through said roll without providing any support to said roll, and mounting said bearing blocks on said spreader between said side frame whereby said roll is mounted rigidly with respect to movement away from the anvil roll without being supported by said shaft.

2. The roll mounting and positioning process of claim 1 wherein said bearing block mounting is movable in a vertical direction perpendicular to said first and second axes of rotation and further comprising the step of vertically adjusting the position of said bearing blocks and therefore said roll carried in said bearing blocks, independently of said driving, and independently of the positioning of said roll axially and circumferentially with respect to said second axis of rotation of said roll.

3. The roll mounting and positioning process of claim 2 further comprising the step of axially adjusting the position of said roll independently of said driving means and independently of the positioning of said roll circumferentially about the axis of rotation of said roll and independently of the positioning of said axis of rotation of said roll with respect to the location of said anvil roll.

4. The roll mounting and positioning process of claim 2 wherein said vertical adjusting comprises camming said bearing blocks by laterally translating a pair of wedges to produce a vertical displacement against the force of said compliant restraint.

5. The roll mounting and positioning process of claim 1 further comprising the step of adjusting the circumferential position of said roll with respect to the web, said circumferential adjusting being independent of said driving and independent of the portioning of said roll axially along its axis of rotation and independently of the positioning of said axis of rotation of said roll with respect to the location of said anvil roll.

6. The roll mounting and portioning process of claim 5 wherein said driving includes connecting to a line shaft, providing means for transmitting rotation to said shaft, operatively coupling said shaft to said roll, wherein said circumferential adjusting comprises adjusting the instantaneous angular relationship with respect to that of said line shaft by adjusting said transmitting means.

7. The roll mounting and positioning process of claims 2, 3, or 5 wherein said adjustings are made independently and while said die roll and anvil roll are rotating.

8. A mounting system for a roll operating in conjunction with an anvil roll where the roll and the anvil roll rotate about parallel axes, comprising a pair of very rigid side frames, a spreader secured between the side frames that is substantially inflexible, means for driving said roll and said anvil roll to rotate about their respective longitudinal and substantially parallel axes said drive means including a shaft supported at its ends in said side frames and passing freely through the roll, and means mounted on said spreader for supporting said roll rotatably and rigidly with respect to movement along a line perpendicular to and coincident with both of said parallel axes of rotation while not being supported by said driving means including said shaft, said driving means and said supporting means being independent so that said driving means transmits only a rotation to said roll.

9. The roll mounting system of claim 8 wherein said supporting means has mechanical means for creating a precise adjustment of the vertical position of said roll through an adjustment component sandwiched between said spreader and said support means and means for compliantly clamping said vertical position adjustment component to transmit the rigidity of said spreader to said support means and therefore to said roll held rotatably in said support means.

10. The roll mounting system of claim 9 wherein said supporting means includes a pair of bearing blocks that rotatably support said roll, and a bed plate that mounts said bearing blocks, said compliant clamping means urging said bed plate in a first vertical direction toward said spreader.

11. The roll mounting system of claim 10 wherein said compliant clamping means includes at least one Belleville spring.

12. The roll mounting system of claim 11 wherein said vertical position adjusting component comprises a pair of wedges oriented with their inclined faces in a mating relationship and positioned to slide laterally with respect to one another under the influence of said clamping means to produce a corresponding, uniform variation in the vertical position of said support means.

13. The roll mounting system of claim 12 wherein said vertical position adjusting means further comprises screw means operatively coupled to at least one of said wedges to produce said lateral sliding movement.

14. The roll mounting system of claim 12 further comprising means for adjusting the axial position of said roll.

15. The roll mounting system of claim 14 wherein said axial position adjusting means comprises at least one lead screw rotatably mounted in said pair of frames and operatively coupled to said roll support means so that rotation of said lead screw produces a corresponding axial movement of said support means.

16. The roll mounting system of claim 15 wherein there are two of said rolls each with one of said support means, including said vertical position adjustment means and said axial position adjusting means, each of said support means and said vertical and axial positioning means acting independently of one another.

17. The roll mounting system of claim 14 wherein said drive means rotates said roll and said anvil roll in coordination and further comprising means for adjusting the circumferential position of said roll independently of said vertical and axial position adjusting means, even while said die roll and anvil roll are rotating.

18. The roll mounting system of claim 17 wherein said driving means includes a rotating line shaft connection and gear means transmitting rotational power from said line shaft to said drive shaft and said anvil roll, and wherein said circumferential position adjustment means comprises means to change the angular relationship between said line shaft and said roll.

19. The roll mounting system of claim 14 wherein said pair of wedges includes one wedge secured in a fixed position with respect to said spreader and a second wedge movable with respect to the first wedge laterally to produce said vertical adjustment.

20. The roll mounting system of claim 19 wherein said bed plate includes side rails that together with the bed plate define a region that accommodates said pair of wedges.

21. The roll mounting system of claim 20 wherein said supporting system and said axial adjustment means include a slideway member secured between said spreader and said fixed wedge and extending axially along the axis of rotation of said roll, a pair of rails axially movable on said slideway member, and wherein said vertical position adjusting means couples said rails with corresponding ones of said bed plate side rails.

22. The roll mounting system of claim 21 wherein said compliant clamping means includes a plurality of bolts that each pass freely through said each of said rails and thread into an associated one of said side rails, and at least one Belleville spring associated with each said bolt, said bolts having a head that captures said at least one Belleville spring between the head and the other of said side rail and rail pairs.

23. The roll mounting system of claim 14 wherein at least one of the opposed includes faces of said pair of wedges is recessed at its central portion.

24. The roll mounting system of claim 14 wherein said movable wedge and the bed plate have a mating tongue and groove extending perpendicular to the axis of rotation of said roll to control the axial position of said wedge during said movement of said wedge for said vertical adjustment.

25. The roll mounting system of claim 8 wherein said driving means comprises a drive shaft that extends between and is rotatably mounted in said frames, and means for operatively coupling said roll and said drive shaft, said coupling means transmitting only a rotation, while otherwise permitting movement of said roll with respect to said drive shaft vertically and axially.

26. The roll mounting system of claim 25 wherein said coupling means comprises axially extending splines on said drive shaft and a central longitudinally extending passage in said roll having complementary mating recesses oversized with respect to the cross-sectional dimensions of the associated ones of said splines.

27. The roll mounting system of claim 8 adapted to act on a web passing between said roll and said anvil roll, further comprising die plates mounted on said roll that are positioned and configured to cut impressions in said web, said roll having a small diameter such that one revolution of said roll corresponds to one repeat of the pattern to be cut by said die in said web, and said roll being sufficiently short that there is substantially no deflection of the roll due to the operating forces of said cutting acting on said roll.

* * * * *